United States Patent [19]

Friedman, Jr. et al.

[11] 4,152,288

[45] May 1, 1979

[54] METHOD AND COMPOSITION FOR NEUTRALIZING STATIC ELECTRICITY

[75] Inventors: Lester A. Friedman, Jr.; James D. Faulkner, both of Atlanta; Allen D. King, Jr., Athens, all of Ga.

[73] Assignee: Lester Laboratories, Inc., Atlanta, Ga.

[21] Appl. No.: 832,862

[22] Filed: Sep. 13, 1977

[51] Int. Cl.[2] ..... C09K 3/30

[52] U.S. Cl. ..... 252/305; 252/357; 252/547; 252/8.8; 252/8.75

[58] Field of Search ..... 252/305, 357, 8.8 AJ, 252/547; 361/212, 215, 225–228

[56] References Cited

U.S. PATENT DOCUMENTS

| | | | |
|---|---|---|---|
| 3,892,669 | 7/1975 | Rapisarda et al. | 252/547 X |
| 3,924,157 | 12/1975 | Peters et al. | 361/225 |
| 3,939,080 | 2/1976 | Martin | 252/1 |
| 3,951,879 | 4/1976 | Wixon | 252/547 |
| 3,959,155 | 5/1976 | Montgomery et al. | 252/547 X |

*Primary Examiner*—Benjamin R. Padgett
*Assistant Examiner*—E. Suzanne Parr
*Attorney, Agent, or Firm*—Beveridge, DeGrandi, Kline and Lunsford

[57] ABSTRACT

A composition comprising an aqueous solution of a quaternary ammonium compound and a surfactant can be sprayed into an atmosphere and the resulting treated atmosphere is capable of neutralizing both positive and negative static charges on objects that come in contact with the treated atmosphere.

28 Claims, 1 Drawing Figure

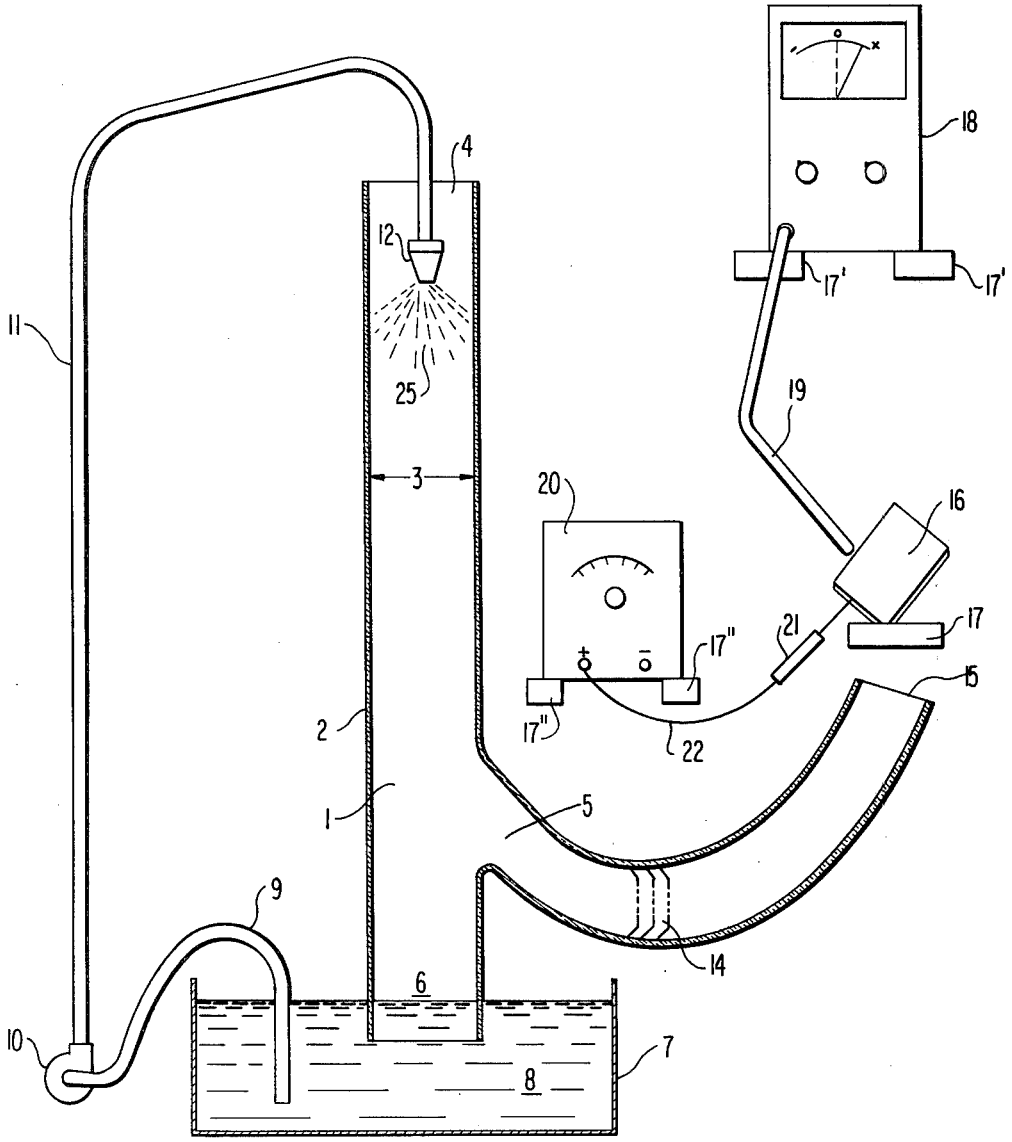
4
12
25
11
3
18
17'
17'
19
20
16
17
21
17"
15
17"
22
2
1
5
9
14
6
10
7
8

METHOD AND COMPOSITION FOR NEUTRALIZING STATIC ELECTRICITY

BACKGROUND OF THE INVENTION

This invention relates to a process and composition for imparting electrical charges to gaseous atmospheres, such as air streams. More particularly, electrical charges are imparted to a gaseous atmosphere by spraying an aqueous solution containing a quaternary ammonium compound and a surfactant into the stream.

Friction between objects of different molecular structures creates static electric charges. This problem is particularly acute in the textile industry where certain textile processing operations require frictional contact between a yarn and various mechanical devices. Depending upon the nature of the yarn, positive or negative charges build up and often lead to deleterious consequences. A safe, economical means of controlling both positive and negative static electricity is, therefore, of considerable interest to the textile industry.

Many attempts have been made in the past to neutralize static electricity. In the textile industry basically two approaches have been employed. One approach involves Corona discharge electrostatic devices and the other employs chemical additives, which are introduced into air-wash systems existing in textile plants. Regardless of the specific device employed, the effectiveness of these methods hinges on their ability to introduce sub-microscopic charged particles into the immediate vicinity where objectionable static build-up occurs.

Corona discharge devices suffer from their inability to produce long-lived charges on the particles they depend upon. The short-lived charges help, but not enough to satisfy the needs in a textile plant.

Most anti-static formulations marketed for use in air-washers suffer from a lack of flexibility in that they are only able to solve half the problem existing in the control of static electricity; that is to say, they are capable of neutralizing positive static charges at the exclusion of negative static charges. They have not been found to be suitable for simultaneously neutralizing positive and negative static charges.

A composition and method for electrifying a gaseous atmosphere are disclosed in U.S. Pat. No. 3,924,157, to Peters and McAmish and assigned to the assignee of the present application. This patent teaches that an aqueous solution of borax and a surfactant can be sprayed into a gaseous stream to impart a positive electrical charge to the stream. In other words, a net positive charge is imparted to the gas stream using this composition. The composition and method have enjoyed a degree of commercial success, but because the composition contains a relatively large amount of borax, it is necessary to market the composition in paste or powder form. To market it in solution form would require such a large amount of water as to make it uneconomical to ship and handle. It would be ideal if a composition capable of neutralizing both positive and negative static charges could be provided. It would also be ideal if such a composition could be made suitable for marketing in liquid form.

U.S. Pat. No. 3,939,080 and U.S. Pat. No. 3,984,731 also disclose a composition and a method for neutralizing static electricity. These patents teach that dodecylbenzyl triethyl ammonium chloride can be added to an air-washer that delivers a flow of air to a room in which static electricity is present. The composition suffers the same deficiencies noted with respect to other anti-static formulations for use in air-washers; namely, only one type of static charge is neutralized to any great extent and in this case it is the negative static charges. Thus, dodecylbenzyl triethyl ammonium chloride operates in a manner similar to a mixture of borax and a surfactant in that each imparts a predominantly net positive charge to an air stream.

Other methods for imparting a charge to a gaseous atmosphere are also known in the art, but each has its unique limitations. For example, merely contacting a gaseous stream with a water spray has been found sufficient to impart an electrical charge to the stream.

In other cases, a high electrical potential is applied to a water spray before being contacted with the gaseous stream. These methods have not proved entirely satisfactory because of the electrical energy requirement, the safety hazards involved and periodic equipment breakdowns.

Still other methods involve the use of radioactive substances. These methods have not proved entirely satisfactory because of the cost of the radioactive materials and the hazards involved in handling such materials. Furthermore, systems employing radioactive materials can be rather costly because of the safeguards that must be provided.

Thus, there exists a need in the art for a process and composition for discharging both positive and negative static build-up. The process and composition should be of relatively low cost, fairly simple and safe to use without the need for costly equipment. The process and composition should ideally be suited for use with existing air-wash systems in textile plants. Preferably, the composition should be marketable in liquid form for ease of handling and for ease of feeding to spray systems. The composition should also have a long shelf life.

SUMMARY OF THE INVENTION

Accordingly, this invention aids in fulfilling these needs in the art by providing a process for imparting an electrical charge to a gaseous stream by contacting the stream with an aqueous composition. The resulting stream treated in this manner is capable of simultaneously neutralizing both positive and negative static charges on objects into which the stream comes in contact.

More particularly, the process of this invention comprises contacting a gaseous atmosphere with an aqueous solution consisting essentially of about 0.5 to about 20 ppm of at least one quaternary ammonium compound of the formula:

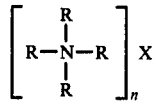

(I)

Each of the R-groups in the quaternary ammonium compound can be the same, in which case each is selected from the group consisting of $C_3$ to $C_8$ substituted or unsubstituted aliphatic groups, or from $C_3$ to $C_8$ substituted or unsubstituted cyclic groups. Alternatively, the R-groups need not be the same, in which case one or two of the R-groups can be independently selected from $C_8$ to $C_{18}$ substituted or unsubstituted aliphatic or cyclic groups and the remaining R-groups are independently selected from substituted or unsubstituted methyl or ethyl groups. The anion X is an inorganic anion. The quaternary ammonium compound is soluble in water to an extent of at least about 0.5 ppm at about 20° C. The aqueous solution also contains about 0.5 to about 50 ppm of at least one surfactant capable of being dissolved in water, which has a surface tension of about 72.75 dynes/cm at 20° C., to thereby form a surfactant solution having a surface tension of about 38 to about 60 dynes/cm at 20° C. when the surfactant solution contains about 0.00005 to about 0.1 weight percent of the surfactant. The surfactant and quaternary ammonium compound are in a weight ratio of surfactant:quaternary ammonium compound of about 1:1 to about 10:1. The resulting atmosphere after treatment with the aqueous solution is capable of simultaneously neutralizing positive and negative static charges on objects with which the treated atmosphere comes in contact.

This invention also provides a composition for carrying out the process of this invention. More particularly, the composition of this invention comprises an aqueous solution consisting essentially of about 0.5 to about 20 ppm of at least one of the aforementioned quaternary ammonium compounds and about 0.5 to about 50 ppm of at least one of the aforementioned surfactants. The surfactant and quaternary ammonium compound are in a weight ratio of surfactant:quaternary ammonium compound of about 1:1 to about 10:1. The aqueous solution is capable of being sprayed into a first atmosphere to form a second atmosphere capable of simultaneously neutralizing positive and negative static electrical charges on objects that come in contact with the second atmosphere.

BRIEF DESCRIPTION OF THE DRAWING

The FIGURE is a diagrammatic illustration of the apparatus employed in the Examples set forth hereinafter.

DETAILED DESCRIPTION

The composition of this invention consists essentially of an aqueous solution of at least one quaternary ammonium compound and at least one surfactant other than a quaternary ammonium compound. The quaternary ammonium compound employed in this invention has the general formula:

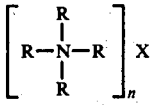

(I)

The R-groups in formula (I) can be identical to each other or different from each other.

In one embodiment of this invention, each of the R-groups has the same number of carbon atoms and is selected from the group consisting of $C_3$ to $C_8$ substituted or unsubstituted aliphatic groups. If the R-groups contain too many carbon atoms, the water solubility of the quaternary ammonium compound may be adversely affected. This may require the use of auxiliary water miscible solvents in the preparation of an aqueous solution of the quaternary ammonium compound by first dissolving the quaternary ammonium compound in the water miscible solvent and then dissolving the resulting solution in water. The aliphatic groups can be branched or straight chain. It will of course be understood that the aliphatic groups can be stereoisomers. Preferably, the aliphatic groups are alkyl groups because of the ready availability of quaternary ammonium compounds containing such groups. Typical of such compounds are tetrabutyl ammonium chloride and tetrabutyl ammonium bromide, the latter compound being particularly preferred in this invention. The aliphatic group can also be unsaturated, for example, ethylenically unsaturated, in which case it would be expected that the solubility of the quaternary ammonium compound in water would be improved.

In another embodiment of this invention each of the R-groups has the same number of carbon atoms and is selected from the group consisting of $C_3$ to $C_8$ substituted or unsubstituted cyclic groups. Typical of these groups are cycloaliphatic groups, such as cyclobutyl and cyclohexyl groups, cycloalkenyl groups, such as cyclohexene or cyclohexadiene groups, and aromatic groups, such as phenyl or benzyl groups.

In a further embodiment the R-groups are different. More particularly, one or two of the R-groups can be independently selected from $C_8$ to $C_{18}$ substituted or unsubstituted aliphatic or cyclic groups and the remaining R-groups are independently selected from substituted or unsubstituted $C_1$ or $C_2$ groups. Here again, there is wide latitude in selecting straight or branch chain, saturated or unsaturated aliphatic groups. Preferably, the aliphatic group is alkyl, but the aliphatic group can also contain unsaturation, such as ethylenic unsaturation. When one or more of the R-groups is cyclic, each will typically be cycloalkyl, cycloalkenyl or aromatic. Typical of the compounds within this class are n-alkyl benzyl ammonium halides, such as the chlorides and bromides. Preferred compounds within this group are mixtures of n-alkyl dimethyl benzyl ammonium chlorides and n-alkyl dimethyl ethylbenzyl ammonium chlorides in which the n-alkyl groups are mixtures of $C_{12}$ to $C_{18}$ alkyl groups. Particularly preferred are such compounds in which the n-alkyl of the dimethyl benzyl ammonium chloride is a mixture containing in weight percent about 60% $C_{14}$ groups, about 30% $C_{16}$ groups, about 5% $C_{12}$ groups and about 5% $C_{18}$ groups, and the n-alkyl of the dimethyl ethylbenzyl ammonium chloride is a mixture containing in weight percent about 50% $C_{12}$ groups, about 30% $C_{14}$ groups, about 17% $C_{16}$ groups and about 3% $C_{18}$ groups. These compounds are marketed under the trade name BARQUAT 4280Z by Lonza, Inc.

The value of n in formula (I) is 1, 2 or 3. This value is generally dictated by the valence of the anion X, which can be any inorganic anion, provided that the quaternary ammonium compound is soluble in water to an extent of at least about 0.5 ppm at about 20° C. Typical of suitable inorganic anions are halides, such as F, Cl, Br and I, sulfate, nitrate and phosphate. Chloride and bromide are preferred.

It will be understood that the R-groups can be substituted by hydrocarbons. For example, the R-groups can be aralkyl or alkaryl. While it is preferred that the R-Groups in formula (I) be hydrocarbons, one or more of the R-groups can be substituted. For example, one or more of the R-groups can be substituted by at least one member selected from the group consisting of Cl, F, Br, I, OH, $NO_2$, $HSO_3$, $NH_2$—, NH=, or an organic functional group, such as $$COOH-,\ CHO-,\ -\overset{\overset{\displaystyle O}{\|}}{C}-,\ -O-,$$

-continued $$-\overset{\overset{\displaystyle O}{\|}}{C}-NH_2,\ -C\equiv N \text{ and } -CNH_2$$

groups. When the R-groups are substituted, it is preferred that the substituents be predominantly hydrophobic.

The amount of the quaternary ammonium compound of formula (I) in the aqueous solution of this invention is about 0.5 to about 20 ppm. For commercial reasons it is desirable to make the aqueous solution of this invention available in concentrated form suitable for dilution with water prior to introduction into a spray system. Suitable solutions for this purpose contain about 0.005 to about 5 weight percent, preferably about 1 to about 2 weight percent of the quaternary ammonium compound of formula (I). In actual use in a spray system, however, the amount of the compound of formula (I) will be about 0.5 to about 20 ppm, since such aqueous solutions are suitable for spraying into an atmosphere without further dilution with water.

The aqueous solution of this invention also contains at least one surfactant, other than a quaternary ammonium compound of formula (I). The surface tension of water against air at 20° C. is 72.75 dynes/cm, and the surfactant employed in this invention is capable of being dissolved in such water to thereby form a surfactant solution having a surface tension against air of about 38 to about 60 dynes/cm at about 20° C. when the surfactant solution contains about 0.0005 to about 0.1 weight percent of the surfactant.

Typical of the surfactants that can be employed in this invention are polyoxyethylene compounds terminated at each end of the molecule by hydrophilic polyoxyethylene groups. They can be represented by the simplified structure:

$$HO(CH_2CH_2-O)_a(\underset{\underset{\displaystyle CH_3}{|}}{CH_2}-CH_2-O)_b(CH_2CH_2-O)_cH$$

A specific example of such a surfactant is Pluronic L-62-LF, which is a condensate of ethylene oxide with a hydrophobic base formed by condensing propylene oxide with propylene glycol. It is a nonionic surfactant having an HLB number of 6.6 and is a liquid available in 100 percent concentration.

Another surfactant suitable for use in this invention is a nonionic surfactant having an HLB number of 3.0. An example of a commercially available surfactant of this type is Pluronic L-61, which is similar in chemical structure to Pluronic L-62-LF. Pluronic L-61 is a liquid having a total average molecular weight of about 1950 and an average molecular weight of the polyoxypropylene base of about 1750. Pluronic L-62-LF is a liquid having an average molecular weight of about 2200, of which about 1750 comprises the polyoxypropylene base. Pluronic L-61 and Pluronic L-62-LF are available from Wyandotte Chemical Corporation.

The term HLB number is used herein in its conventional sense as being an expression of the hydrophile-lipophile balance of the surfactant. It is a measure of the size and strength of the hydrophilic and the lipophilic groups of the surfactant.

Another surfactant suitable for use in this invention is an anionic sulfonate. An example of a commercially available surfactant of this type is Petro 22. Petro 22 is a sodium methyl naphthalene sulfonate available from Petro Chemical Company, Inc.

Other suitable surfactants are caprylic dicarboxylate imidazoline derivatives. Typical of such surfactants is Cycloteric MV-SF, which is an amphoteric surfactant available from Cyclo Chemicals Corp.

Other suitable surfactants include modified oxyethylated straight-chain alcohols, such as Plurafac RA-10, which is a nonionic surfactant available from BASF Wyandotte Industries Chemicals Group.

A particularly preferred surfactant for use in this invention is comprised of a mixture of Cycloteric MV-SF and Plurafac RA-10 in a weight ratio of 3:2.

The amount of surfactant employed is about 0.5 to about 50 ppm. While aqueous solutions suitable for spraying into an atmosphere contain about 0.5 to about 50 ppm of the surfactant, the previously mentioned commercial solutions suitable for dilution with water will generally contain about 0.05 to about 10% by weight of the surfactant. A particularly preferred solution for commercial purposes contains about 5% by weight of a surfactant mixture, which is comprised of about 3% by weight Cycloteric MV-SF and about 2% by weight Plurafac RA-10. This solution can be diluted to the required concentration before use in a spray system.

The aqueous solution of this invention, which is suitable for spraying into an atmosphere, contains the surfactant and the quaternary ammonium compound in a weight ratio of surfactant:quaternary ammonium compound of about 1:1 to about 10:1. A preferred solution contains the surfactant and quaternary ammonium compound in a weight ratio of about 5:1.

As used herein the term "consisting essentially of" is to be given its generally accepted meaning as requiring that specified components be present, but not excluding unspecified components that do not materially detract from the basic and novel characteristics of the invention.

The term "spraying" is to be understood as the process of dispersing a liquid in a gas, and the products obtained from such a process include sprays, mists, and fogs. Essentially, the spraying operation employed in this invention involves the formation of a suspension or dispersion of minute particles or clusters of minute particles in a gas.

The process of this invention involves treating an atmosphere with the solution of the invention wherein the resulting treated atmosphere is capable of simultaneously neutralizing positive and negative static electrical charges on objects with which said treated atmosphere comes in contact. Generally, the atmosphere will be air. Other atmospheres can be employed provided that the constituents of the atmosphere do not substantially chemically react with the composition of this invention. Thus, an inert gas atmosphere can be employed. Typical of the constituents in such an inert gas atmosphere are nitrogen, and the noble gases, such as helium, neon, argon, krypton and xenon. The atmosphere can be comprised of a single element or compound or mixture of several elements and compounds. The term "atmosphere" is intended to include both gases and vapors. The atmosphere can be in the form of gaseous stream into which the composition of this invention is sprayed.

The spraying operation employed in this invention can be conducted in spray systems well known in the art. A number of spray systems are in commercial use.

Typical of such systems are spray columns, cyclone sprayers, venturi air washers, and jet scrubbers or washers. The spray system generally includes a spray nozzle or a series of spray nozzles, which can form, for example, a spray manifold. This invention is especially useful in air-washers of the type employed in textile plants.

As used herein, the term "spray nozzle" refers to the device for breaking into droplets the aqueous solution of this invention. Generally speaking, the spray nozzle can be a pressure nozzle, rotating nozzle (spinning atomizer) or a gas-atomizing nozzle (two fluids nozzle, pneumatic atomizer). Spray nozzles employed in air moistening, air washing, humidification, scrubbing and washing of gases are well known in the art. Typical examples of nozzles include solid-cone wide-angle sprayers, narrow-angle sprayers, hollow-cone sprayers, pressure atomizing spray nozzles, air- or gas-atomizing sprayers and rotating-disk sprayers.

It has been found that temperature has an effect on the operation of the process of this invention. Specifically, it has been found that spraying the aqueous solution of this invention into an atmosphere at low temperatures seems to result in a greater rate of discharge of static charges on objects with which the atmosphere comes in contact. For example, while the temperature of water is normally about 70° to 75° F., lowering the temperature of an aqueous solution of this invention to about 58° F. enhances the rate of discharge of both positive and negative static charges by about 15%.

When the aqueous solution of this invention is sprayed into an atmosphere, it is possible to neutralize both positive and negative static electric charges. For example, if an atmosphere treated according to the process of this invention comes in contact with an object that has a positive or negative static electrical charge, the magnitude of the static charge will be substantially reduced and can even be completely neutralized. It is also possible to simultaneously neutralize positive and negative static charges on objects. This is particularly advantageous in the textile industry in which processing operations can give rise to both positive and negative static electrical charges. When the composition of this invention is employed in conventional air-washers in a textile plant, such positive and negative static electrical charges on different objects can be simultaneously neutralized.

Another feature of the present invention is that it is possible to tailor the composition of this invention to neutralize static charges of different magnitude. This is made possible by the use of both a quaternary ammonium compound and the surfactant previously described. The use of the quaternary ammonium compound makes it possible to neutralize negative charges on objects, whereas the use of the surfactant makes it possible to neutralize positive charges on objects. Thus, if one encounters an environment in which the magnitude of negative static charges is greater than the magnitude of positive static charges, a proportionately larger amount of quaternary ammonium compound can be employed. Conversely, if positive static charges are of larger magnitude, a smaller amount of quaternary ammonium compound or an anionic surfactant or both can be employed. The magnitude and type of charge can be predicted for many systems using the triboelectric series, which lists substances of various compositions as follows:

Asbestos
Glass
Human hair
Nylon
Wool
Fur
Lead
Silk
Aluminum
Paper
Cotton
Steel
Sealing wax
Hard rubber
Acetate rayon
Nickel-copper
Brass-silver
Synthetic rubber
Polyester
Orlon
Saran
Polyethylene
Teflon
Silicone rubber.

The first rule in applying the triboelectric series is that the farther apart two materials are in the scale, the more readily static is generated. The second rule is that a material near the top of the series is positive with respect to the materials below it. For example, a nylon yarn moving in contact with a steel capstan will result in the yarn being positively charged and the steel capstan being negatively charged. By contacting these materials with an atmosphere treated according to the process of this invention, it is possible to neutralize both the positive and negative static electrical charges.

This result is indeed surprising since one would expect the quaternary ammonium compound and the surfactant to counteract each other so that an atmosphere into which they were sprayed would itself be neutral. In other words, one would expect the net charge of a treated atmosphere to be 0. For some unknown reason, this does not occur. An atmosphere treated according to the process of this invention can simultaneously neutralize both positive and negative static electrical charges.

Another surprising observation made during the course of this invention was that the quaternary ammonium compound and surfactant are extremely effective in very small concentrations. For example, concentrations as low as 0.5 ppm for each ingredient have been found to produce significant effects in the neutralization of static electrical charges.

The results achieved according to the process and composition of this invention will be more fully appreciated from the Examples hereinafter. All parts, proportions, percentages and ratios are by weight unless otherwise indicated.

DESCRIPTION OF THE TEST PROCEDURE AND APPARATUS

The FIGURE is an illustration of the air-washer apparatus employed in the following Examples. An air-washing chamber 1 is formed by a glass pipe 2 having a diameter 3 of about 6" and an overall length of about 42". The glass pipe 2 has an inlet opening 4 at the top and an outlet pipe 5 near the bottom 6 of pipe 2. Air enters inlet 4, which is spaced about 21" from the center of pipe 5.

A sump generally indicated as 7 is provided and comprises a five-gallon plastic pan containing an aqueous solution 8 of the composition of this invention or other material to be sprayed into glass pipe 2.

A plastic (Tygon) tube 9 of about ⅝ inch inside diameter is submerged in the solution 8 and extends to a pump 10, which pumps the solution from sump 7 through plastic tube 11 up to spray nozzle 12. The pump is a Model 4 MD manufactured by Little Giant Co. The tube 11 is of the same material as tube 9.

Pipe 5 is provided with a plastic anti-carry-over baffle 14, which removes entrained liquid carried over from spray 25 in pipe 2. Near the open end 15 of pipe 5 is located a stainless steel plate 16, which is 15 cm square and about 1/100 inch thick. Stainless steel plate 16 is suspended via a styrofoam block 17 which is maintained in place by means not shown. A Keithley Model 600B electrometer 18 is used to monitor the charge on the plate 16 via a static probe 19 which is positioned approximately 2–3 millimeters from the plate surface. The electrometer 18 is also isolated from the surroundings by styrofoam blocks 17'. An electrical charge is placed on stainless steel plate 16 by means of a 1000 v. power supply 20 having positive (+) and negative (−) terminals. This is accomplished by contacting stainless steel plate 16 with probe 21 connected to the power supply 20 via a wire 22. Again, the power supply 20 is isolated from the surroundings by styrofoam blocks 17''. The electrical apparatus is grounded to a water-pipe to minimize the effects of stray currents.

During operation, the system is activated by starting pump 10, which recirculates the aqueous solution 8 in sump 7 to the spray nozzle 12. This results in a gentle flow of air entering inlet 4. It has been found that laminar flow of the atmosphere into which the solution is sprayed is preferred. Turbulent flow appears to lower the rate at which the charge on plate 16 is neutralized. While the reason for this is not entirely understood, it may be caused by the charge carriers contacting the walls of the apparatus. Since the outlet 6 of pipe 2 is submerged in aqueous solution 8, air entering the inlet 4 of pipe 2 must exit through pipe 5. The air flow through pipes 1 and 5 caused by the venturi effect originating at nozzle 12.

A positive or negative charge is then placed on stainless steel plate 16 by means of the power supply 20 and the probe 21. As shown in the FIGURE, a positive charge has been placed on plate 16. If tap water is circulated in the air wash apparatus depicted in the FIGURE, the needle of the electrometer 18 will move back to its center or zero position as indicated by the broken line in the FIGURE. This means that the positive charge applied to the stainless steel plate 16 has been neutralized by the atmosphere exiting from pipe 5. The plate will retain its charge essentially indefinitely if the airstream from pipe 5 is blocked off, e.g. by a sheet of cardboard.

This arrangement has been found to be convenient for testing various aqueous solutions and to determine their effect on positive and negative electrical charges. The effects produced by various types of aqueous solutions will be more apparent from the following Examples.

In the following Examples, the sump 7 was charged with the aqueous solution indicated in the respective Example and the pump 10 was started. Plate 16 was initially grounded by touching it while the electrometer 18 was zeroed to center scale. Power supply 20 was then used to charge the plate 16 either positive or negative, as desired (up to 1000 volts). A reading of 5 indicates full scale deflection. The change in the reading on the electrometer 18 was then observed for a period of 60 seconds and the readings recorded at 10 second intervals. These measurements give an indication of the rate of discharge of the electrical charge on plate 16. At the end of each 60 second run, the plate 16 was grounded so that any meter drift could be observed; these are reported as ground values.

The temperature of the solution sprayed into the air stream in each case was about 21° C., unless otherwise indicated. The water used in all of the Examples was tap water from the public water supply of the city of East Point, Georgia.

EXAMPLE 1

COMPARATIVE EXAMPLE USING TAP WATER

When tap water alone was added to the sump 7 and plate 16 alternately charged positive and negative, the following electrometer readings were made.

| TIME | CHARGE ON PLATE | |
|---|---|---|
| (SEconds) | Negative | Positive |
| 0 | 4.6 | 4.4 |
| 10 | 4.6 | 3.1 |
| 20 | 4.55 | 2.0 |
| 30 | 4.55 | 1.2 |
| 40 | 4.55 | 0.6 |
| 50 | 4.55 | 0.2 |
| 60 | 4.2 | 0.0 |
| Ground Value | −0.2 | +0.1 |

These results indicate that a spray of tap water dissipates a positive charge on plate 16 much faster than a negative charge. In fact, it is seen that a spray of tap water alone is relatively ineffective in neutralizing a negative electrical charge in a short period of time.

EXAMPLE 2

COMPARATIVE EXAMPLE USING WATER+QUATERNARY AMMONIUM COMPOUND

Example 1 is repeated except that an aqueous solution containing 1 ppm tetrabutyl-ammonium bromide (TBAB) is added to the sump. The following results were observed.

| TIME | CHARGE ON PLATE | |
|---|---|---|
| (Sec.) | (−) | (+) |
| 0 | 4.4 | 4.4 |
| 10 | 3.4 | 4.2 |
| 20 | 2.7 | 4.1 |
| 30 | 2.0 | 4.0 |
| 40 | 1.5 | 3.8 |
| 50 | 0.9 | 3.7 |
| 60 | 0.5 | 3.6 |
| Ground Value | 0.0 | + 0.1 |

TBAB reverses the behavior of a system based on water alone. TBAB in water neutralizes a negative charge on the plate more rapidly than it neutralizes a positive charge.

EXAMPLE 3

COMPARATIVE EXAMPLE USING WATER+SURFACTANT

Example 1 is repeated except that an aqueous solution containing 1 ppm Pluronic L-62-LF was added to the sump. The following results were observed.

| TIME (Sec.) | CHARGE ON PLATE (−) | (+) |
|---|---|---|
| 0 | 5.0 | 5.0 |
| 10 | 4.9 | 2.8 |
| 20 | 4.7 | 1.3 |
| 30 | 4.5 | 0.5 |
| 40 | 4.3 | 0.1 |
| 50 | 4.2 | −0.2 |
| 60 | 4.0 | −0.3 |
| Ground Value | +0.2 | 0.0 |

This Example indicates that a surfactant can accelerate the rate of discharge of positive electrical charges above that normally achieved with water alone. While the plate actually became slightly negative during the sixty second run, this may have been due to the plate picking up excess charge from the air stream. The foregoing effects are maintained up to a surfactant concentration of about 6 to about 8 ppm, at which point the solution behaves very similar to water alone. That is, it is still possible to neutralize positive charges, but the rate of discharge is not as great as with the very low concentrations of surfactant.

Furthermore, as the amount of surfactant is increased, the behavior of the treated air stream toward a negatively charged plate remains substantially unchanged, while the ability of the treated air stream to discharge a positively charged plate is diminished. Runs at 40 and 80 ppm L-62-LF illustrate this trend.

| TIME (Sec.) | 40 ppm (+) | (−) | 80 ppm (+) | (−) |
|---|---|---|---|---|
| 0 | 5.0 | 5.0 | 4.8 | 5.0 |
| 10 | 4.0 | 4.9 | 4.0 | 4.9 |
| 20 | 3.1 | 4.7 | 3.7 | 4.7 |
| 30 | 2.2 | 4.6 | 3.1 | 4.6 |
| 40 | 1.6 | 4.5 | 2.6 | 4.4 |
| 50 | 1.2 | 4.3 | 2.1 | 4.2 |
| 60 | .8 | 4.2 | 1.8 | 4.0 |
| Ground Value | 0.0 | 0.0 | 0.0 | 0.0 |

EXAMPLE 4

WATER+SURFACTANT+QUATERNARY AMMONIUM COMPOUND

The following composition was prepared.

| | PARTS BY WEIGHT |
|---|---|
| TBAB | 1 |
| Sodium methyl naphthalene sulfonate (Petro 22) | 5 |
| Corrosion Inhibitors and Anti-scaling agents | 14 |
| Water | 80 |

When this solution was added to the sump at the concentrations indicated below, the results set forth in the following Table were obtained:

| TIME (Sec.) | 100 ppm (+) | (−) | 125 ppm (+) | (−) | 175 ppm (+) | (−) | 275 ppm (+) | (−) | 1275 ppm (+) | (−) |
|---|---|---|---|---|---|---|---|---|---|---|
| 0 | 4.9 | 5.0 | 4.8 | 5.0 | 4.9 | 5.0 | 4.9 | 4.9 | 4.9 | 5.0 |
| 10 | 4.3 | 4.6 | 4.3 | 4.6 | 4.3 | 4.5 | 4.3 | 4.5 | 4.6 | 4.6 |
| 20 | 3.8 | 4.3 | 3.9 | 4.2 | 3.9 | 4.1 | 3.9 | 4.1 | 4.3 | 4.2 |
| 30 | 3.3 | 3.9 | 3.4 | 3.8 | 3.4 | 3.7 | 3.5 | 3.6 | 3.9 | 3.9 |
| 40 | 2.8 | 3.6 | 3.0 | 3.4 | 3.0 | 3.3 | 3.1 | 3.2 | 3.6 | 3.6 |
| 50 | 2.3 | 3.3 | 2.6 | 3.1 | 2.8 | 3.0 | 2.8 | 2.8 | 3.3 | 3.4 |
| 60 | 2.0 | 3.0 | 2.3 | 2.9 | 2.5 | 2.7 | 2.5 | 2.5 | 3.1 | 3.1 |
| Ground Value | +0.2 | +0.2 | +.2 | +0.2 | +0.2 | +0.2 | 0 | +.1 | 0 | +.2 |

It is apparent that the results obtained with the composition of Example 4 are less dependent on concentration. That is, the rate of discharge of positive and negative charges is less susceptible to concentration of the composition of this Example.

The composition of this invention can include other additives that do not materially detract from its ability to neutralize positive and negative static electric charges. Typical of such additives that can optionally be employed include antifoaming agents; corrosion inhibitors; antioxidants; chelating agents; colorants, such as dyes and pigments; buffering agents; lubricants; anti-bacterial and anti-fungal agents; odor neutralizers; etc.

The applications for the composition and process of this invention will be immediately apparent to persons skilled in the art of static control. Relatively large and troublesome amounts of static electricity are frequently generated in textile and paper mills. The composition and the method of this invention can be employed to substantially reduce or completely neutralize positive and negative static electrical charges in such environments. The composition and method of this invention are suitable for use in air-washer equipment of the type conventionally employed in such installations. Thus, this invention is particularly advantageous since additional costly equipment is frequently not required.

There are other advantages provided by this invention. The composition of this invention is comprised mainly of water and is, therefore, of relatively low cost. Moreover, the other ingredients employed in the composition are readily available. The compositions of this invention are very easy to prepare by simply mixing the ingredients together. Additionally, they can be sold in concentrated form suitable for dilution at the time of use. Since the composition of this invention is a liquid, it is particularly suitable for automatic feeding to conventional air-washer systems. Furthermore, the compositions are safe and easy to handle and have a relatively long shelf life. The composition of this invention can be tailored to suit environments containing both negative and positive static electric charges of differing magnitudes. This invention makes it possible to completely neutralize static charges in a predictable, controllable and reproducible manner.

What is claimed is:

1. A process for imparting an electrical charge to an atmosphere, said process comprising contacting said atmosphere with an aqueous solution by spraying said aqueous solution into said atmosphere, wherein said aqueous solution consists essentially of:

(A) about 0.5 to about 20 ppm of at least one quaternary ammonium compound of the formula

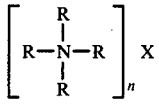

wherein (1) each of the R-groups is the same and is selected from the group consisting of $C_3$ to $C_8$ substituted or unsubstituted aliphatic or cyclic groups; or (2) one or two of the R-groups are independently selected from $C_8$ to $C_{18}$ substituted or unsubstituted aliphatic or cyclic groups and the remaining R-groups are independently selected from substituted or unsubstituted $C_1$ to $C_2$ groups; X is an inorganic anion; n equals 1, 2 or 3; said quaternary ammonium compound being soluble in water to an extent of at least about 0.5 ppm at about 20° C.; and (B) about 0.5 to about 50 ppm of at least one surfactant capable of being dissolved in water having a surface tension against air of about 72.75 dynes/cm at 20° C. to thereby form a surfactant solution having a surface tension against air of about 38 to about 60 dynes/cm at 20° C. when said surfactant solution contains about 0.0005 to about 0.1 weight percent of said surfactant; and said surfactant and said quaternary ammonium compound are in a weight ratio of surfactant:quaternary ammonium compound of about 1:1 to about 10:1, and wherein the resulting treated atmosphere is capable of simultaneously neutralizing positive and negative static electrical charges on objects with which said treated atmosphere comes in contact.

2. Process according to claim 1 in which each of said R-groups is a branched or straight chain aliphatic group.

3. Process according to claim 1 wherein each of said R-groups is an unsubstituted aliphatic group.

4. Process according to claim 1 wherein at least one of said R-groups is an unsaturated alkyl group.

5. Process according to claim 1 in which at least one of said R-groups is substituted by at least one member selected from the group consisting of Cl, F Br, I, OH, $NO_2$, $HSO_3$, $NH_2$—,

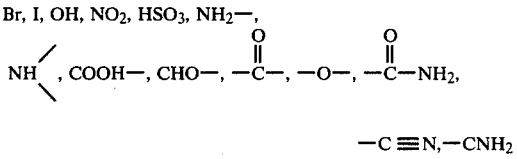

groups and in which said quaternary ammonium compound is capable of forming micelles in aqueous solution.

6. Process according to claim 1 wherein at least one of said R-groups is a substituted or unsubstituted aryl group.

7. Process according to claim 1 wherein each of said R-groups is a $C_4H_9$—group and X is bromide.

8. Process according to claim 7 wherein each of the R-groups is identical.

9. Process according to claim 1 in which X is a chloride, fluoride, bromide, iodide, sulfate, nitrate or phosphate ion.

10. Process according to claim 1 in which said surfactant is selected from the group consisting of (a) a nonionic surfactant having an HLB number of 6.6, (b) a nonionic surfactant having an HLB number of 3.0, (c) an amphoteric caprylic dicarboxylate imidazoline derivative surfactant, (d) a nonionic modified oxyethylated straight chain alcohol surfactant, and (e) an anionic sodium sulfonate.

11. Process according to claim 1 in which said weight ratio of surfactant to quaternary ammonium compound is about 5:1.

12. A composition comprising an aqueous solution consisting essentially of:

(A) about 0.5 to about 20 ppm of at least one quaternary ammonium compound of the formula:

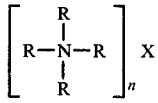

wherein (1) each of the R-groups is the same and is selected from the group consisting of $C_3$ to $C_8$ substituted or unsubstituted aliphatic or cyclic groups; or (2) one or two of the R-groups are independently selected from $C_8$ to $C_{18}$ substituted or unsubstituted aliphatic or cyclic groups and the remaining R-groups are independently selected from substituted or unsubstituted $C_1$ to $C_2$ groups;

X is an inorganic anion; n equals 1, 2 or 3; said quaternary ammonium compound being soluble in water to an extent of at least about 0.5 ppm at about 20° C.; and (B) about 0.5 to about 50 ppm of at least one surfactant capable of being dissolved in water having a surface tension against air of about 72.75 dynes/cm at 20° C. to thereby form a surfactant solution having a surface tension against air of about 38 to about 60 dynes/cm at 20° C. when said surfactant solution contains about 0.0005 to about 0.1 weight percent of said surfactant; and said surfactant and said quaternary ammonium compound are in a weight ratio of surfactant:quaternary ammonium compound of about 1:1 to about 10:1, and wherein said aqueous solution is capable of being sprayed into a first atmosphere to form a second atmosphere capable of simultaneously neutralizing positive and negative static electrical charges on objects in contact with said second atmosphere.

13. Composition according to claim 12 in which each of said R-groups is a branched or straight chain aliphatic group.

14. Composition according to claim 12 wherein each of said R-groups is an unsubstituted aliphatic group.

15. Composition according to claim 12 wherein at least one of said R-groups is an unsaturated alkyl group.

16. Composition according to claim 12 in which at least one of said R-groups is substituted by at least one member selected from the group consisting of Cl, F, Br, I, OH, $NO_2$, $HSO_3$, $NH_2$—,

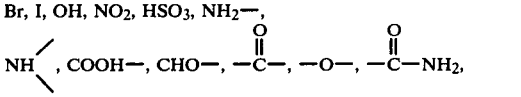

groups, and in which said quaternary ammonium compound is capable of forming micelles in aqueous solution.

17. Composition according to claim 12 wherein at least one of said R-groups is a substituted or unsubstituted aryl group.

18. Composition according to claim 12 wherein each of said R-groups is a $C_4H_9$-group and X is bromide.

19. Composition according to claim 18 wherein each of the R-groups is identical.

20. Composition according to claim 12 in which X is a chloride, fluoride, bromide, iodide, sulfate, nitrate or phosphate ion.

21. Composition according to claim 12 wherein said surfactant is selected from the group consisting of (a) a nonionic surfactant having an HLB number of 6.6, (b) a nonionic surfactant having an HLB number of 3.0, (c) an amphoteric caprylic dicarboxylate imidazoline derivative surfactant, (d) a nonionic modified oxyethylated straight chain alcohol surfactant, and (e) an anionic sodium sulfonate.

22. Composition according to claim 12 in which said surfactant is comprised of a mixture of (a) an amphoteric caprylic dicarboxylate imidazoline derivative surfactant, and (b) a nonionic modified oxyethylated straight chain alcohol surfactant.

23. Composition according to claim 12 in which said weight ratio of surfactant to quaternary ammonium compound is about 5:1.

24. A process for simultaneously neutralizing positive and negative static electric charges on objects, said process comprising contacting a gaseous atmosphere with an aqueous solution by spraying said aqueous solution into said gaseous atmosphere, wherein said aqueous solution consists essentially of:

(A) about 0.5 to about 20 ppm of at least one quaternary ammonium compound of the formula

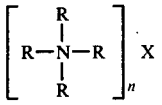

wherein (1) each of the R-groups is the same and is selected from the group consisting of $C_3$ to $C_8$ substituted or unsubstituted aliphatic or cyclic groups; or (2) one or two of the R-groups are independently selected from $C_8$ to $C_{18}$ substituted or unsubstituted aliphatic or cyclic groups and the remaining R-groups are independently selected from substituted or unsubstituted $C_1$ or $C_2$ groups;

X is an inorganic anion; n equals 1, 2 or 3; said quaternary ammonium compound being soluble in water to an extent of at least about 0.5 ppm at about 20° C; and (B) about 0.5 to about 50 ppm of at least one surfactant capable of being dissolved in water having a surface tension against air of about 72.75 dynes/cm at 20° C. to thereby form a surfactant solution having a surface tension against air of about 38 to about 60 dynes/cm at 20° C. when said surfactant solution contains about 0.0005 to about 0.1 weight percent of said surfactant; and said surfactant and said quaternary ammonium compound are in a weight ratio of surfactant:quaternary ammonium compound of about 1:1 to about 10:1; wherein said surfactant consists essentially of a mixture of (a) an amphoteric caprylic discarboxylate imidazoline derivative surfactant, and (b) a nonionic modified oxyethylated straight chain alcohol surfactant; and wherein the resulting treated atmosphere is capable of simultaneously neutralizing positive and negative static electric charges on objects with which said treated atmosphere comes in contact.

25. A composition for controlling positive and negative static electric charges on objects, said composition consisting essentially of an aqueous solution of:

(A) about 0.5 to about 20 ppm tetrabutyl ammonium bromide, and (B) about 0.5 to about 50 ppm of at least one surfactant capable of being dissolved in water having a surface tension against air of about 72.75 dynes/cm at 20° C. to thereby form a surfactant solution having a surface tension against air of about 38 to about 60 dynes/cm at 20° C. when said surfactant solution contains about 0.0005 to about 0.1 weight percent of said surfactant; and wherein said surfactant and said quaternary ammonium compound are in a weight ratio of surfactant:quaternary ammonium compound of about 1:1 to about 10:1; and wherein said surfactant is comprised of a mixture of (a) an amphoteric caprylic dicarboxylate imidazoline derivative surfactant, and (b) a nonionic modified oxyethylated straight chain alcohol surfactant; and wherein said aqueous solution is capable of being sprayed into a first atmosphere to form a second atmosphere capable of simultaneously neutralizing positive and negative static electric charges on objects in contact with said second atmosphere.

26. A process for simultaneously neutralizing positive and negative static electric charges on objects, said process comprising I. contacting an atmosphere with an aqueous solution by spraying said aqueous solution into said atmosphere, wherein said aqueous solution consists essentially of:

(A) about 0.5 to about 20 ppm of tetrabutyl ammonium bromide; and (B) about 0.5 to about 50 ppm of at least one surfactant capable of being dissolved in water having a surface tension against air of about 72.75 dynes/cm at 20° C. to thereby form a surfactant solution having a surface tension against air of about 38 to about 60 dynes/cm at 20° C. when said surfactant solution contains about 0.0005 to about 0.1 weight percent of said surfactant; and said surfactant and said quaternary ammonium compound are in a weight ratio of surfactant- :quaternary ammonium compound of about 1:1 to about 10:1, and II. contacting objects having positive and negative static electric charges thereon with the resulting treated atmosphere from step I, wherein the said treated atmosphere is capable of simultaneously neutralizing positive and negative static electric charges on said objects.

27. A process for imparting an electrical charge to an atmosphere, said process comprising contacting said atmosphere with an aqueous solution by spraying said aqueous solution into said atmosphere, wherein said aqueous solution consists essentially of:

(A) about 0.5 to about 20 ppm of tetrabutyl ammonium bromide; and (B) about 0.5 to about 50 ppm of at least one surfactant capable of being dissolved in water having a surface tension against air of about 72.75 dynes/cm at 20° C. to thereby form a surfactant solution having a surface tension against air of about 38 to about 60 dynes/cm at 20° C. when said surfactant solution contains about 0.0005 to about 0.1 weight percent of said surfactant; and said surfactant and said quaternary ammonium compound are in a weight ratio of surfactant:quaternary ammonium compound of about 1:1 to about 10:1; wherein said surfactant is selected from the group consisting of (1) a sodium methyl naphthalene sulfonate surfactant, and (2) a polyoxyethylene compound terminated at each end of the molecule by hydrophilic polyoxyethylene groups, wherein sad polyoxyethylene compound has an HLB number of 6.6 and comprises a reaction product formed by condensing propylene oxide with propylene glycol; and wherein the resulting treated atmosphere is capable of simultaneously neutralizing positive and negative static electrical charges on objects with which said treated atmosphere comes in contact.

28. A composition comprising an aqueous solution consisting essentially of:

(A) about 0.5 to about 20 ppm tetrabutyl ammonium bromide; and (B) about 0.5 to about 50 ppm of at least one surfactant capable of being dissolved in water having a surface tension against air of about 72.75 dynes/cm at 20° C. to thereby form a surfactant solution having a surface tension against air of about 38 to about 60 dynes/cm at 20° C. when said surfactant solution contains about 0.0005 to about 0.1 weight percent of said surfactant; and said surfactant and said quaternary ammonium compound are in a weight ratio of surfactant:quaternary ammonium compound of about 1:1 to about 10:1, wherein said surfactant is selected from the group consisting of (1) a sodium methyl naphthalene sulfonate surfactant, and (2) a polyoxyethylene compound terminated at each end of the molecule by hydrophilic polyoxyethylene groups, wherein said polyoxyethylene compound has an HLB number of 6.6 and comprises a reaction product formed by condensing propylene oxide with propylene glycol; and wherein said aqueous solution is capable of being sprayed into a first atmosphere to form a second atmosphere capable of simultaneously neutralizing positive and negative static electrical charges on objects in contact with said second atmosphere.

* * * * *